US007566394B2

(12) United States Patent
Koseoglu

(10) Patent No.: US 7,566,394 B2
(45) Date of Patent: Jul. 28, 2009

(54) ENHANCED SOLVENT DEASPHALTING PROCESS FOR HEAVY HYDROCARBON FEEDSTOCKS UTILIZING SOLID ADSORBENT

(75) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 426 days.

(21) Appl. No.: 11/584,771

(22) Filed: Oct. 20, 2006

(65) Prior Publication Data

US 2008/0093260 A1 Apr. 24, 2008

(51) Int. Cl.
*C10C 3/08* (2006.01)

(52) U.S. Cl. ..... 208/309; 208/310 R; 208/310 Z; 208/313; 208/314; 208/321; 208/45

(58) Field of Classification Search ..... 208/309, 208/310 R, 310 Z, 313, 314, 321, 45
See application file for complete search history.

(56) References Cited

U.S. PATENT DOCUMENTS

| | | | | |
|---|---|---|---|---|
| 3,227,645 | A | 1/1966 | Frumkin et al. | |
| 3,252,894 | A | 5/1966 | Gatsis et al. | |
| 4,239,616 | A | 12/1980 | Gearhart | |
| 4,290,880 | A | 9/1981 | Leonard | |
| 4,305,814 | A | 12/1981 | Leonard | |
| 4,411,790 | A | 10/1983 | Arod et al. | |
| 4,427,539 | A | 1/1984 | Busch et al. | |
| 4,502,944 | A | 3/1985 | Nelson | |
| 4,572,781 | A * | 2/1986 | Krasuk et al. | 208/309 |
| 4,663,028 | A | 5/1987 | Ditman | |
| 4,747,936 | A | 5/1988 | Penning | |
| 4,810,367 | A | 3/1989 | Chombart et al. | |
| 4,816,140 | A * | 3/1989 | Trambouze et al. | 208/309 |
| 4,885,080 | A | 12/1989 | Brown et al. | |
| 5,374,350 | A | 12/1994 | Heck et al. | |
| 6,558,531 | B2 | 5/2003 | Steffens et al. | |
| 6,783,662 | B2 | 8/2004 | Draemel et al. | |
| 6,805,790 | B2 | 10/2004 | Gupta et al. | |
| 2006/0175229 | A1 | 8/2006 | Montanari et al. | |
| 2007/0267327 | A1 * | 11/2007 | Boakye | 208/253 |

FOREIGN PATENT DOCUMENTS

WO YS07/22381 (ISR) 10/2007

* cited by examiner

*Primary Examiner*—Tam M Nguyen
(74) *Attorney, Agent, or Firm*—Abelman, Frayne & Schwab

(57) ABSTRACT

A solvent deasphalting of crude oil or petroleum heavy fractions and residues is carried out in the presence of a solid adsorbent, such as clay, silica, alumina and activated carbon, which adsorbs the contaminants and permits the solvent and oil fraction to be removed as a separate stream from which the solvent is recovered for recycling; the adsorbent with contaminants and the asphalt bottoms is mixed with aromatic and/or polar solvents to desorb the contaminants and washed as necessary, e.g., with benzene, toluene, xylenes and tetrahydrofuran, to clean adsorbant which is recovered and recycled; the solvent-asphalt mixture is sent to a fractionator for recovery and recycling of the aromatic or polar solvent. The bottoms from the fractionator include the concentrated PNA and contaminants and are further processes as appropriate.

11 Claims, 1 Drawing Sheet

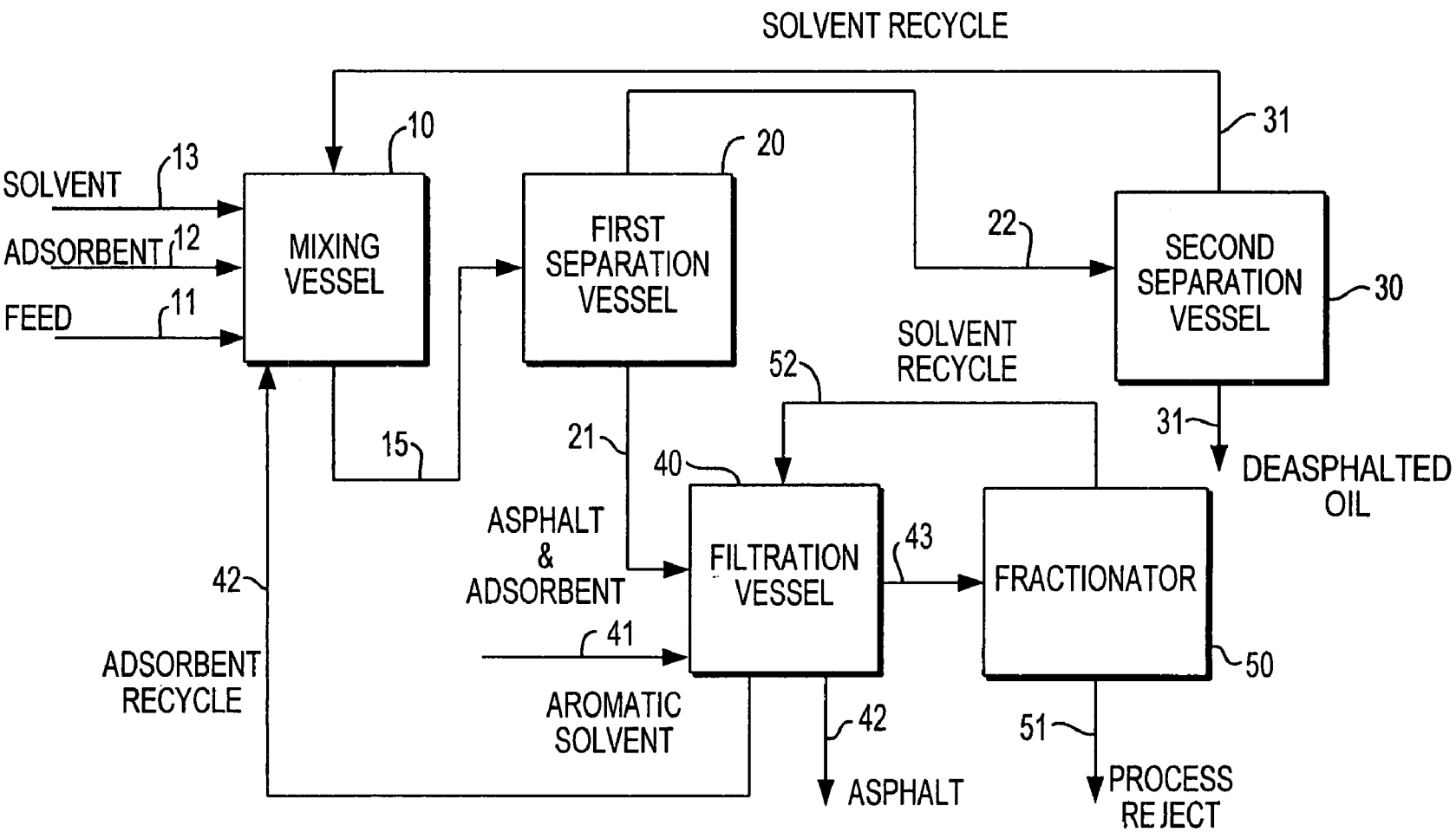
SOLVENT RECYCLE
31
SECOND SEPARATION VESSEL
30
DEASPHALTED OIL
31
22
SOLVENT RECYCLE
FRACTIONATOR
50
PROCESS REJECT
51
20
FIRST SEPARATION VESSEL
52
FILTRATION VESSEL
43
42
ASPHALT
40
21
ASPHALT & ADSORBENT
41
AROMATIC SOLVENT
10
MIXING VESSEL
15
42
ADSORBENT RECYCLE
13
SOLVENT
12
ADSORBENT
11
FEED

ENHANCED SOLVENT DEASPHALTING PROCESS FOR HEAVY HYDROCARBON FEEDSTOCKS UTILIZING SOLID ADSORBENT

FIELD OF THE INVENTION

The invention relates to the solvent deasphalting of heavy oils in the presence of solid adsorbents.

BACKGROUND OF THE INVENTION

Crude oils contain heteroatomic polyaromatic molecules that include compounds such as sulfur, nitrogen, nickel, vanadium and others in quantities that can adversely effect the refinery processing of the crude oil fractions. Light crude oils or condensates have sulfur concentrations as low as 0.01 percent by weight (W %). In contrast, heavy crude oils and heavy petroleum fractions have sulfur concentrations as high as 5-6 W %. Similarly, the nitrogen content of crude oils can be in the range of 0.001-1.0 W %. These impurities must be removed during refining to meet established environmental regulations for the final products (e.g., gasoline, diesel, fuel oil), or for the intermediate refining streams that are to be processed for further upgrading, such as isomerization reforming. Contaminants such as nitrogen, sulfur and heavy metals are known to deactivate or poison catalysts.

Asphaltenes, sometime also referred to as asphalthenes, which are solid in nature and comprise polynuclear aromatics present in the solution of smaller aromatics and resin molecules, are also present in the crude oils and heavy fractions in varying quantities. Asphaltenes do not exist in all of the condensates or in light crude oils; however, they are present in relatively large quantities in heavy crude oils and petroleum fractions. Asphaltenes are insoluble components or fractions and their concentrations are defined as the amount of asphaltenes precipitated by addition of an n-paraffin solvent to the feedstock as prescribed in the Institute of Petroleum Method IP-143.

The chemical structure of asphaltenes are complex and are comprised of polynuclear hydrocarbons of molecular weight up to 20,000 joined by alkyl chains. Asphaltenes include nitrogen, sulfur and oxygen. Asphaltene has been defined as the component of a heavy crude oil fraction that is precipitated by addition of a low-boiling paraffin solvent, or paraffin naphtha, such as normal pentane, and is soluble in carbon disulfide and benzene. The heavy fraction can contain asphaltenes when it is derived from carbonaceous sources such as petroleum, coal or oil shale. Asphaltogenic compounds are present in petroleum in insignificant quantities. There is a close relationship between asphaltenes, resins and high molecular weight polycyclic hydrocarbons. Asphaltenes are hypothesized to be formed by the oxidation of natural resins. The hydrogenation of asphaltic compounds containing neutral resins and asphaltene produces heavy hydrocarbon oils, i.e., neutral resins and asphaltenes are hydrogenated into polycyclic aromatic or hydroaromatic hydrocarbons. They differ from polycyclic aromatic hydrocarbons by the presence of oxygen and sulfur in varied amounts.

Upon heating above 300°-400° C., asphaltenes are not melted, but decompose, forming carbon and volatile products. They react with sulfuric acid to form sulfonic acids, as might be expected on the basis of the polyaromatic structure of these components. Flocs and aggregates of asphaltene will result from the addition of non-polar solvents, e.g., paraffinic solvents, to crude oil and other heavy hydrocarbon oil feedstocks.

In a typical refinery, crude oil is first fractionated in the atmospheric distillation column to separate sour gas including methane, ethane, propanes, butanes and hydrogen sulfide, naphtha (36°-180° C.), kerosene (180°-240° C.), gas oil (240°-370° C.) and atmospheric residue, which are the hydrocarbon fractions boiling above 370° C. The atmospheric residue from the atmospheric distillation column is either used as fuel oil or sent to a vacuum distillation unit, depending upon the configuration of the refinery. Principal products from the vacuum distillation are vacuum gas oil, comprising hydrocarbons boiling in the range 370°-520° C., and vacuum residue, comprising hydrocarbons boiling above 520° C.

Naphtha, kerosene and gas oil streams derived from crude oils or other natural sources, such as shale oils, bitumens and tar sands, are treated to remove the contaminants, such as sulfur, that exceed the specification set for the end product(s). Hydrotreating is the most common refining technology used to remove these contaminants. Vacuum gas oil is processed in a hydrocracking unit to produce gasoline and diesel, or in a fluid catalytic cracking (FCC) unit to produce mainly gasoline, low cycle oil (LCO) and high cycle oil (HCO) as by-products, the former being used as a blending component in either the diesel pool or in fuel oil, the latter being sent directly to the fuel oil pool.

There are several processing options for the vacuum residue fraction, including hydroprocessing, coking, visbreaking, gasification and solvent deasphalting. Solvent deasphalting is practiced commercially worldwide. In the solvent deasphalting process, the asphalt fraction comprising 6-8 W % of hydrogen is separated from the vacuum residue by contact with a paraffinic solvent (carbon number ranging from 3-8) at elevated temperatures and pressures. The deasphalted oil comprising 9-11 W % hydrogen, is characterized as a heavy hydrocarbon fraction that is free of asphaltene molecules and can be sent to other conversion units such as a hydrocracking unit or a fluid catalytic cracking unit for further processing.

The deasphalted oil contains a high concentration of such contaminants as sulfur, nitrogen and Conradson which is an indicator of the coke forming properties of heavy hydrocarbons and defined as micro-Conradson residue (MCR) or Conradson carbon residue (CCR). MCR is determined by ASTM Method D-4530. In this test, the residue remaining after a specified period of evaporation and pyrolysis is expressed as a percentage of the original sample For example, deasphalted oil obtained from vacuum residue of an Arabian crude oil, contains 4.4 W % of sulfur, 2,700 ppmw of nitrogen and 11 W % of micro-carbon residue. In another example, a deasphalted oil of Far East origin contains 0.14 W % sulfur, 2,500 ppmw of nitrogen and 5.5 W % of CCR. These high levels of contaminants, and particularly nitrogen, in the deasphalted oil cause poor performance in conversion in hydrocracking or FCC units. The adverse effects of nitrogen and micro-carbon residue in FCC operations has been reported to be as follows: 0.4-0.6 higher coke yield, 4-6 V % less gasoline yield and 5-8 V % less conversion per 1000 ppmw of nitrogen. (See Sok Yui et al., Oil and Gas Journal, Jan. 19, 1998.) Similarly, coke yield is 0.33-0.6 W % more for each one W % of MCR in the feedstock. In hydrocracking operations, the catalyst deactivation is a function of the feedstock nitrogen and MCR content. The catalyst deactivation is about 3-5° C. per 1000 ppmw of nitrogen and 2-4° C. for each one W % of MCR.

It has been established that organic nitrogen is the most detrimental catalyst poison present in the hydrocarbon streams from the sources identified above. The organic nitrogen compounds poison the active catalytic sites which results in the deactivation of the catalyst, which in turn adversely effects the catalyst cycle or process length, the life of the catalyst, product yields, product quality, increases the severity of operating conditions and the associated cost of plant construction and operations. Removing nitrogen, sulfur, metals and other contaminants that poison catalysts will improve refining operations and will have the advantage of permitting refiners to process more and/or heavier feedstocks.

A number of processes have been disclosed for deasphalting of hydrocarbon oils that are based upon the use of paraffinic solvents that cause the asphaltenes to form a precipitate that can be recovered.

In U.S. Pat. No. 4,816,140, a process is described for deasphalting a hydrocarbon oil with a solvent having 3-8 carbon atoms, resulting in an asphaltic phase and a solution of deasphalted oil in the solvent. The solvent is then separated from the deasphalted oil, by passing the solution across an inorganic membrane of pore radii from 2 to 15 nanometers. The deasphalted oil is selectively retained on the upstream side of the membrane.

In U.S. Pat. No. 4,810,367, a process for deasphalting a heavy hydrocarbon feedstock is disclosed, comprising two stages of precipitation from the feedstock of an asphaltene fraction alone or, alternatively, of a resin fraction along with the asphaltene fraction, by means of a heavy solvent and a light solvent, respectively. In accordance with the process, the heavy solvent and the light solvent both contain, in different proportions, at least one hydrocarbon having 3 carbon atoms and at least one hydrocarbon having at least 5 carbon atoms, the proportion of the hydrocarbon having 3 carbon atoms being higher in the light solvent than in the heavy solvent.

In U.S. Pat. No. 4,747,936, a process for deasphalting and demetallizing heavy oils includes a counter-flow washing step which increases the yield of the product oil by contacting a heavy oil feedstream in countercurrent flow with a solvent in a multi-stage extraction zone and a resulting light phase stream is heated and passed into a settling zone. A second light phase stream comprised of the deasphalted product and demetallized oil and solvent is separated in the settling zone from a contaminant-laden heavy phase which is also termed a resin phase. The settling zone contains an equilibrium amount of DMO and solvent. DMO-enriched solvent is displaced from the resin stream by means of a counter-flow washing process using pure solvent.

In U.S. Pat. No. 4,572,781, a process for solvent deasphalting in solid phase is described that separates substantially dry asphaltenes of high softening point from heavy hydrocarbon material, comprising several steps described as: (a) admixing heavy hydrocarbon material containing asphaltenes with a solution of deasphalted oil and an aliphatic hydrocarbon precipitant in a first mixing zone to form a mixture and precipitate asphaltenes; (b) in a first separation zone the mixture from step (a) into (i) a first solution of deasphalted oil and precipitant and (ii) a slurry of solid asphaltene particles in a solution of precipitant and deasphalted oil; (c) separating the first solution of step (b) to obtain said precipitant and the deasphalted oil almost free of asphaltenes; (d) introducing the slurry of asphaltenes of step (b) into a second mixing zone and washing the slurry with a volume of fresh precipitant to remove deasphalted oil; (e) introducing the mixture from the second mixing zone into a second separation zone that comprises a centrifugal decanter to separate a liquid phase from a highly concentrated slurry of solid asphaltene; (f) recycling the liquid phase from the second separation zone to said first mixing zone; (g) introducing the concentrated slurry of solid asphaltenes from the second separation zone into a solvent removal system to recover the solvent and to obtain a product comprising fine particles of high softening point asphaltenes; and (h) recycling the solvent recovered in the solvent removal system to the second mixing zone.

In U.S. Pat. No. 4,502,944, a process for fractionation of heavy hydrocarbon process material resins and asphaltenes into at least three fractions is disclosed. The process material is mixed in a mixing zone with a solvent selected from the group consisting of paraffinic hydrocarbons having between about 3 to about 8 carbon atoms. The process material-solvent mixture is introduced into a first separation zone to form an asphaltenes-rich first heavy fraction and a resin-rich intermediate fraction, separated by a first liquid-liquid interface, and to form a first light fraction, rich in solvent and oils, separated from the intermediate fraction by a second liquid-liquid interface. The first heavy fraction and the intermediate fraction are withdrawn from the first separation zone. The first light fraction is introduced into a second separation zone to separate a second heavy fraction, rich in oils, and a second light fraction, rich in solvent.

In U.S. Pat. No. 4,411,790, a process for the treatment of a hydrocarbon charge by high temperature ultrafiltration is disclosed which is said to be useful for the regeneration of waste oil and to the reduction of the rate of asphaltenes in a hydrocarbon charge. The process comprises the steps of circulating the charge in a module having at least one mineral ultrafiltration barrier coated with a sensitive mineral layer of at least one metal oxide and of operating at a temperature higher than 100° C. The barrier, which preferably has a ceramic or metallic support, is coated with a sensitive layer selected from titanium dioxide, magnesium oxide, aluminum oxide, spinel $MgAl_2O_4$, and silica.

In U.S. Pat. No. 4,239,616, a process is described for effecting a deep cut in a heavy hydrocarbon material without a decrease in the quality of the extracted oil caused by the presence of undesirable entrained resinous bodies. The heavy hydrocarbon material is admixed with a solvent and introduced into a first separation zone maintained at an elevated temperature and pressure to effect a separation of the feed into a first light phase and a first heavy phase comprising asphaltenes and some solvent. The first light phase is introduced into a second separation zone maintained at an elevated temperature and pressure to effect a separation of the first light phase into a second light phase comprising oils and solvent and a second heavy phase comprising resins and some solvent. A portion of the first heavy phase is withdrawn and introduced into an upper portion of the second separation zone to contact the second light phase, after which it separates therefrom. This contact removes at least a portion of any entrained resinous bodies from the oil contained in the second light phase.

In U.S. Pat. No. 4,305,814, an energy efficient process for separating hydrocarbonaceous materials into various fractions is disclosed. The hydrocarbonaceous material is admixed with a solvent and the mixture is introduced into a first separation zone maintained at an elevated first temperature and pressure. The feed mixture separates into a first light phase comprising solvent and at least a portion of the lightest hydrocarbonaceous material and a first heavy phase comprising the remainder of the hydrocarbonaceous material and some solvent. The first heavy phase is introduced into a second separation zone maintained at a second temperature level above the first temperature level and at an elevated pressure. The first heavy phase separates into a second light phase comprising solvent and a second heavy phase comprising at least a portion of the hydrocarbonaceous material. The separated hydrocarbonaceous material fractions are recovered.

In U.S. Pat. No. 4,290,880, a supercritical process for producing deasphalted demetallized and deresined oils is disclosed. A process for effecting a deep cut in a heavy hydrocarbon material without a decrease in the quality of the extracted oil caused by the presence of undesirable entrained resinous bodies and organometallic compounds. The heavy hydrocarbon material is contacted with a solvent in a first separation zone maintained at an elevated temperature and pressure to effect a separation of the feed into a first light phase and a first heavy phase comprising asphaltenes and some solvent. The first light phase is introduced into a second separation zone maintained at an elevated temperature and pressure to effect a separation of the first light phase into a second light phase comprising oils and solvent and a second heavy phase comprising resins and some solvent. A portion of the second heavy phase is withdrawn and introduced into an upper portion of the second separation zone to counter-currently contact the second light phase. This contact removes at least a portion of any entrained resinous bodies and organometallic compounds from the oils contained in the second light phase.

A supercritical extraction process is disclosed in U.S. Pat. No. 4,482,453 in which the recovery of hydrocarbon values from a feedstream with high metals content can be carried out more efficiently via supercritical extraction with the recycle of a portion of the asphalt product and proper control of a countercurrent solvent flow during extraction.

In U.S. Pat. No. 4,663,028, a process of preparing a donor solvent for coal liquefaction is described in which liquefied coal is distilled to separate the coal into a fraction having a boiling point less than about 350° F. and a fraction having a boiling pit greater than about 350° F. The residue from the distillation is deasphalted in a first solvent capable of substantially extracting a first oil comprising lower molecular weight compounds and saturated compounds. The residue from the first deasphalting step is then deasphalted in a second solvent capable of substantially extracting a second oil comprising concentrated aromatic and heterocyclic compounds and leaving in the residue asphaltenes and ash. The second oil can be used as a donor solvent. The second oil extracted in the second deasphalting step is preferably partially hydrogenated prior to use as a donor solvent for the liquefaction of coal.

The prior art processes described above utilize various solvent extraction schemes for deasphalting petroleum fractions to improve the quality of the downstream products and the overall efficiency of the refinery. However, additional improvements in product quality and process efficiency are highly desirable.

It is therefore an object of the present invention to provide an improved solvent deasphalting process in which the treated feedstock will have a substantially reduced level of such contaminants as nitrogen, sulfur and metal compounds.

Another object of the invention is to provide an improved solvent deasphalting process in which the solvents are recovered and recycled for use.

It is also an object of the invention to provide an improved process for solvent deasphalting of a heavy residue oil or fraction that is efficient and effective under relatively mild and easily controlled conditions, thereby providing versatility.

The process is applicable to naturally occurring hydrocarbons such as crude oils, bitumens, heavy oils, shale oils and refinery streams that include atmospheric and vacuum residues, fluid catalytic cracking slurry oils, coker bottoms, visbreaking bottoms and coal liquefaction by-products.

SUMMARY OF THE INVENTION

The above objects and advantages are achieved by the process of the present invention which broadly comprehends the solvent deasphalting of heavy hydrocarbon feedstocks in the presence of an adsorbent which removes the nitrogen-containing polynuclear hydrocarbons from the deasphalted oils to thereby improve the performance of refinery processing units, including hydrocracking and fluid catalytic cracking units. In accordance with the invention, the solvent deasphalting of crude oil or petroleum heavy fractions and residues is carried out in the presence of a solid adsorbent, such as clay, silica, alumina, activated carbon, and fresh or used zeolitic catalyst materials, which adsorbs the contaminants and permits the solvent and oil fraction to be removed as a separate stream from which the solvent is recovered for recycling; the adsorbent with contaminants and the asphalt bottoms are mixed with aromatic and/or polar solvents to desorb the contaminants and washed as necessary, e.g., with benzene, toluene, xylenes and tetrahydrofuran, to clean the adsorbent, which can preferably be recovered and recycled; the solvent-asphalt mixture is sent to a fractionator for recovery and recycling of the aromatic or polar solvent. The bottoms from the fractionator include the concentrated PNA and contaminants and are further processed as appropriate.

In one particularly preferred embodiment, the process includes the steps of:

a. providing a heavy hydrocarbon feedstock containing asphaltenes, derived from natural resources including crude oil, bitumen, tar sands and shale oils, or from refinery processes including atmospheric or vacuum residue, coker gas oils, heavy cycle gas oils from fluid catalytic cracking operations and visbroken gas oils, and mixtures thereof having a high nitrogen content and PNA molecules;

b. mixing the hydrocarbon feedstock in a vessel with a $C_3$ to $C_7$ paraffinic solvent, preferably a mixture of $C_4$ normal and iso-butane, at a temperature and a pressure that are below the solvent's critical pressure and temperature, to thereby disturb the equilibrium of the asphaltenes in malthenes solution and to flocculate the solid asphaltene particles;

c. adsorbing the nitrogen-containing polynuclear aromatics from the malthenes and asphaltenes on a solid adsorbent that is present in the mixing vessel in a ratio of from 20:0.1 W/W, and preferably 10:1 W/W, of feed-to-adsorbent;

d. separating solid phase asphaltenes and adsorbent from the liquid phase in a first separator vessel and transferring the bottoms to a filtration vessel and the upper liquid layer to a second separation vessel;

e. separating the deasphalted oil in the second separation vessel and recovering the paraffinic solvent for recycling to the mixing vessel;

f. separating the asphalt from the adsorbent in the filtration vessel by washing the adsorbent with aromatic and/or polar solvents and transferring the solvent and oil mixture to a fractionator to recover the solvent and discharging the asphalt mixture from the filtration vessel;

g. fractionating the solvent in the fractionator to recover the aromatic and/or polar solvent for recycling to the filtration vessel; and h. recovering the heavy oil polynuclear hydrocarbon stream having a relativity higher concentration of nitrogen and sulfur compounds.

The invention thus provides refiners with an improved process to remove undesired heavy hydrocarbon fractions and residues from process feedstreams in order to further improve the efficiency of current operations. The process of the invention provides for the recycling of the two solvents used and also of the solid adsorbent, thereby providing economic and environmental advantages.

The type of solvent selected for use in the process of the invention will effect the product yields and can be based upon the desired quality of the deasphalted oil stream.

BRIEF DESCRIPTION OF THE DRAWING

The invention will be further described below and with reference to the attached drawing which is a schematic illustration of one embodiment of an apparatus suitable for use in the practice of the invention.

DETAILED DESCRIPTION OF THE INVENTION

Referring now to the drawing which is illustrative of a preferred embodiment of the invention, a heavy hydrocarbon feedstream 11 is introduced into a mixing vessel 10 equipped with suitable mixing means, e.g., rotary stirring blades or paddles, which provide a gentle, but thorough mixing of the contents. Also present in the vessel are feedstreams constituting a paraffinic $C_3$ to $C_7$ solvent 12 and solid adsorbent slurry 13. The rate of agitation for a given vessel and mixture of adsorbent, solvent and feedstock is selected so that there is minimal, if any, attrition of the adsorbent particles. Conditions are maintained below the critical temperature and pressure of the solvent. The mixing is continued for 30 to 150 minutes, the duration being related to the components of the mixture.

The mixture is discharged through line 15 to a first separation vessel 20 at a temperature and pressure that is below the solvent's critical values to separate the feed mixture into an upper layer comprising light and less polar fractions that are removed as stream 22 and bottoms comprising asphaltenes and the solid adsorbent that are removed as stream 21. A vertical flash drum can be utilized for this separation step.

The recovered stream 22 is introduced into a second separation vessel 30 maintained at a temperature between the solvent's boiling and critical temperature while maintaining a pressure of between one and three bars to separate solvent from the deasphalted oil. The solvent stream 32 is recovered and returned to the mixing vessel 10, preferably in a continuous operation. The deasphalted oil stream 31 is discharged from the bottom of the vessel 30. Analyses for sulfur using ASTM D5453, nitrogen using ASTM D5291, and metals (nickel and vanadium) using ASTM D3605 indicate that the oil has a greatly reduced level of contaminants, i.e., it contains no metals, and about 80 W % of the nitrogen and 20-50 W % of the sulfur have been removed that were present in the original feedstream.

The bottoms from the first separation vessel 20 comprising asphalt and adsorbent slurry stream 21, is mixed with an aromatic and/or polar solvent stream 41. The solvent stream 41 can consist of benzene, toluene, xylenes or tetrahydrofuran in a filtration vessel 40 to separate and clean the adsorbent material.

Solvents can be selected based on their Hildebrand solubility factors or on the basis of two-dimensional solubility actors. The overall Hildebrand solubility parameter is a well-known measure of polarity and has been tabulated for numerous compounds. (See, for example, *Journal of Paint Technology*, Vol. 39, No. 505, February 1967). The solvents can also be described by two-dimensional solubility parameters, i.e., the complexing solubility parameter and the field force solubility parameter. (See, for example, I. A. Wiehe, Ind. & Eng. Res., 34(1995), 661). The complexing solubility parameter component which describes the hydrogen bonding and electron donor-acceptor interactions measures the interaction energy that requires a specific orientation between an atom of one molecule and a second atom of a different molecule. The field force solubility parameter which describes van der Waal's and dipole interactions measures the interaction energy of the liquid that is not effected by changes in the orientation of the molecules.

In accordance with this invention, the polar solvent, or solvents, if more than one is employed, preferably has an overall solubility parameter greater than about 8.5 or a complexing solubility parameter of greater than one and a field force parameter value greater than 8. Examples of polar solvents meeting the desired solubility parameter are toluene (8.91), benzene (9.15), xylene (8.85), and tetrahydrofuran (9.52). Preferred polar solvents for use in the practice of the invention are toluene and tetrahydrofuran.

The adsorbent is preferably washed with two or more aliquots of the aromatic or polar solvent in order to dissolve and remove the adsorbed compounds. The clean solid adsorbent stream 44, is recovered and recycled to the mixing vessel 10. The solvent-asphalt mixture is withdrawn from the filtering vessel 40 as stream 43 and sent to a fractionator 50 to separate the solvent from the material containing the heavy polynuclear aromatic compounds which are withdrawn as stream 51 for appropriate disposal. The clean aromatic and/or polar solvent is recovered as stream 52 and recycled to filtration vessel 40.

The following Table provides critical temperature and pressure data for $C_3$ to $C_7$ paraffinic solvents:

TABLE

| Carbon Number | Temperature, ° C. | Pressure, bar |
|---|---|---|
| $C_3$ | 97 | 42.5 |
| $C_4$ | 152 | 38.0 |
| $C_5$ | 197 | 34.0 |
| $C_6$ | 235 | 30.0 |
| $C_7$ | 267 | 27.5 |

As will be apparent to those of ordinary skill in the art, the additional equipment and utilities requirements for the improved solvent deasphalting process of the present invention are minimal, the principal additions being the filtration vessel and the second separation vessel.

EXAMPLE 1

Solvent Deasphalting with Solvent Only

In a comparative solvent deasphalting process, a feedstock of vacuum residue oil that contains 5.4 W % sulfur, 4,300 ppmw nitrogen and 24.6 W % MCR from Arabian origin was treated with solvent that is a mixture of normal and isopentanes, and yields 71 W % and 29 W %, respectively, of deasphalted oil and asphaltenes. The sulfur, nitrogen and MCR content of the deasphalted oil was 4.4 W %, 2,700 ppmw and 13.7 W %, respectively. About 20 W % of sulfur, 37 W % of nitrogen and 44.6 W % of MCR were removed from the vacuum residue oil in this prior art process.

EXAMPLE 2

Solvent Deasphalting with Solvent and Adsorbent

In this example, the solvent deasphalting is carried out with a solid adsorbent in addition to the solvent in accordance with the present invention. The process is conducted at 30° C. and at 3 g/cm2 pressure with normal pentane and attapulgus clay. The vacuum residue from Arabian origin containing 5.4 W % sulfur, 4,300 ppmw nitrogen, 24.6 W % MCR yields deasphalted oil with 2.6 W % of sulfur, 1,400 ppmw of nitrogen and 8.2 W % of microcarbon residue.

These results establish that the use of a solid adsorbent to adsorb some of the contaminant heteroatom-containing polyaromatic molecules in conjunction with a solvent deasphalting treatment will provide a reduction of these contaminants that have a detrimental effect on the downstream refining processes.

The process of the invention has been described and explained with reference to the schematic process drawing and example. Additional variations and modifications may be apparent to those of ordinary skill in the art based on the above description and the scope of the invention is to be determined by the claims that follow.

I claim:

1. A solvent deasphalting process comprising:

a. introducing a hydrocarbon oil feedstock containing asphaltenes into a mixing vessel with a paraffinic solvent and a solid adsorbent material selected from the group consisting of attapulgus clay, alumina, silica activated carbon and zeolite catalyst materials;

b. mixing the solid asphaltenes formed in the paraffinic solvent phase with the adsorbent material for a time sufficient to adsorb sulfur- and nitrogen-containing polynuclear aromatic molecules on the adsorbent material;

c. separating the solid phase comprising asphaltenes and adsorbent from the oil/solvent mixture;

d. passing the oil/solvent mixture to a separation vessel to separate the deasphalted oil and paraffinic solvent and recovering the solvent for recycling to the mixing vessel;

e. passing the asphalt/adsorbent mixture to a filtration vessel with an aromatic or polar solvent to desorb the adsorbed compounds and to recover the solid asphalt phase; and f. passing the aromatic or polar solvent mixture to a fractionator to recover the solvent.

2. The process of claim 1 which is conducted at a temperature in the range of from 20° to 200° C. and at a pressure of from 1 to 100 kg/cm$^2$.

3. The method of claim 1 in which the solid phase is separated in step (c) by filtration to provide a cleaned feedstream substantially free of adsorbent.

4. The method of claim 3 which includes desorbing and removing the nitrogen-containing PNA from the adsorbent material after the filtration step to thereby regenerate the adsorbent material.

5. The process of claim 1, wherein the hydrocarbon feedstock is derived a from natural source selected from crude oil, tar sands, bitumen and shale oils.

6. The process of claim 1, where the hydrocarbon feedstock is derived from refining processes selected from the group consisting of atmospheric and vacuum residue, fluid catalytic cracking, slurry oil, coker bottom oils, visbreaker bottoms and coal liquefaction oils.

7. The process of claim 1, wherein 1 to 50 V % of hydrocarbon feedstock is recovered as deasphalted oil for further refining processes including hydrocracking, fluid catalytic cracking and visbreaking.

8. The process of claim 2 wherein 1 to 50 V % of hydrocarbon feedstock is recovered as asphalt for processing in an asphalt unit and refining processes including hydrocracking, coking and visbreaking.

9. The process of claim 8, wherein the high nitrogen content fraction is blended in fuel oil, or processed in an asphalt unit, a hydrocracking, coking or visbreaking unit.

10. The process of claim 1, wherein the adsorbent material is packed in a fixed bed column.

11. The process of claim 2, wherein the adsorbent packing is selected from adsorbent materials consisting of pellets, spheres, extrudates and natural products of a size in the range of 4-60 mesh.

* * * * *

UNITED STATES PATENT AND TRADEMARK OFFICE

CERTIFICATE OF CORRECTION

PATENT NO. : 7,566,394 B2
APPLICATION NO. : 11/584771
DATED : July 28, 2009
INVENTOR(S) : Omer Refa Koseoglu It is certified that error appears in the above-identified patent and that said Letters Patent is hereby corrected as shown below:

Delete Title Page, and replace with new Title Page. (Attached)

In the Drawings

Delete Figure 1, and replace with Figure 1, as shown below.

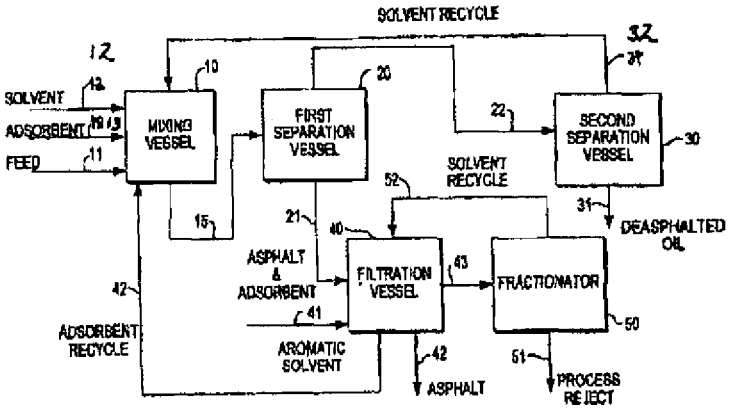

Signed and Sealed this
Eighth Day of July, 2014

Michelle K. Lee

Michelle K. Lee
*Deputy Director of the United States Patent and Trademark Office*

(12) United States Patent
Koseoglu

(10) Patent No.: US 7,566,394 B2
(45) Date of Patent: Jul. 28, 2009

(54) ENHANCED SOLVENT DEASPHALTING PROCESS FOR HEAVY HYDROCARBON FEEDSTOCKS UTILIZING SOLID ADSORBENT

(75) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 426 days.

(21) Appl. No.: 11/584,771

(22) Filed: Oct. 20, 2006

(65) Prior Publication Data

US 2008/0093260 A1 Apr. 24, 2008

(51) Int. Cl.
*C10C 3/08* (2006.01)

(52) U.S. Cl. ..... 208/309; 208/310 R; 208/310 Z; 208/313; 208/314; 208/321; 208/45

(58) Field of Classification Search ..... 208/309, 208/310 R, 310 Z, 313, 314, 321, 45
See application file for complete search history.

(56) References Cited

U.S. PATENT DOCUMENTS

| | | | | |
|---|---|---|---|---|
| 3,227,645 | A | 1/1966 | Frumkin et al. | |
| 3,252,894 | A | 5/1966 | Gatsis et al. | |
| 4,239,616 | A | 12/1980 | Gearhart | |
| 4,290,880 | A | 9/1981 | Leonard | |
| 4,305,814 | A | 12/1981 | Leonard | |
| 4,411,790 | A | 10/1983 | Arod et al. | |
| 4,427,539 | A | 1/1984 | Busch et al. | |
| 4,502,944 | A | 3/1985 | Nelson | |
| 4,572,781 | A * | 2/1986 | Krasuk et al. | 208/309 |
| 4,663,028 | A | 5/1987 | Ditman | |
| 4,747,936 | A | 5/1988 | Penning | |
| 4,810,367 | A | 3/1989 | Chombart et al. | |
| 4,816,140 | A * | 3/1989 | Trambouze et al. | 208/309 |
| 4,885,080 | A | 12/1989 | Brown et al. | |
| 5,374,350 | A | 12/1994 | Heck et al. | |
| 6,558,531 | B2 | 5/2003 | Steffens et al. | |
| 6,783,662 | B2 | 8/2004 | Draemel et al. | |
| 6,805,790 | B2 | 10/2004 | Gupta et al. | |
| 2006/0175229 | A1 | 8/2006 | Montanari et al. | |
| 2007/0267327 | A1 * | 11/2007 | Boakye | 208/253 |

FOREIGN PATENT DOCUMENTS

WO YS07/22381 (ISR) 10/2007

* cited by examiner

*Primary Examiner*—Tam M Nguyen
(74) *Attorney, Agent, or Firm*—Abelman, Frayne & Schwab

(57) ABSTRACT

A solvent deasphalting of crude oil or petroleum heavy fractions and residues is carried out in the presence of a solid adsorbent, such as clay, silica, alumina and activated carbon, which adsorbs the contaminants and permits the solvent and oil fraction to be removed as a separate stream from which the solvent is recovered for recycling; the adsorbent with contaminants and the asphalt bottoms is mixed with aromatic and/or polar solvents to desorb the contaminants and washed as necessary, e.g., with benzene, toluene, xylenes and tetrahydrofuran, to clean adsorbant which is recovered and recycled; the solvent-asphalt mixture is sent to a fractionator for recovery and recycling of the aromatic or polar solvent. The bottoms from the fractionator include the concentrated PNA and contaminants and are further processes as appropriate.

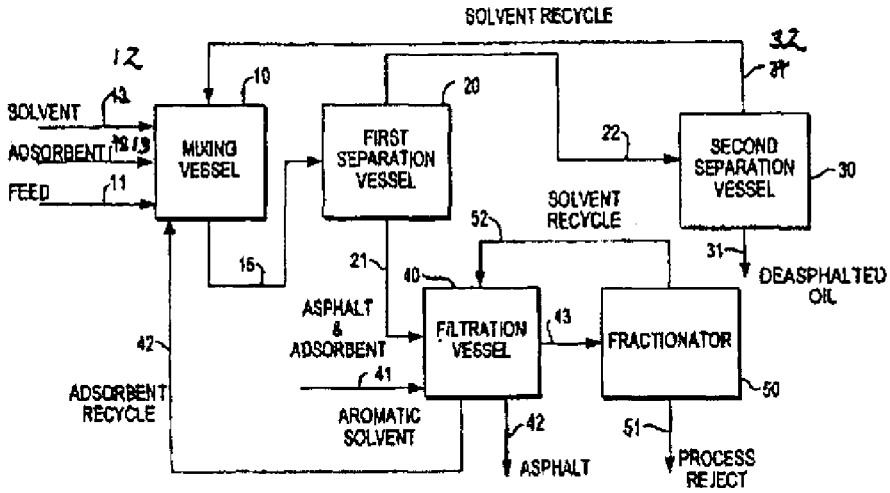

11 Claims, 1 Drawing Sheet